United States Patent [19]

Wedel

[11] Patent Number: 5,031,338

[45] Date of Patent: Jul. 16, 1991

[54] VACUUM ROLL TRANSFER APPARATUS

[75] Inventor: Gregory L. Wedel, Beloit, Wis.

[73] Assignee: Beloit Corporation, Beloit, Wis.

[21] Appl. No.: 612,284

[22] Filed: Nov. 9, 1990

Related U.S. Application Data

[60] Division of Ser. No. 243,742, Sep. 9, 1988, Pat. No. 4,980,979, which is a continuation-in-part of Ser. No. 14,569, Feb. 13, 1987, Pat. No. 4,934,067.

[51] Int. Cl.[5] ..... F26B 11/02

[52] U.S. Cl. ..... 34/115; 34/117; 34/120

[58] Field of Search ..... 34/23, 116, 117, 120, 34/115; 162/192, 368, 370, 371

[56] References Cited

U.S. PATENT DOCUMENTS 4,483,083 1/1984 Chance ..... 34/116

4,882,854 11/1989 Wedel et al. ..... 34/115

*Primary Examiner*—Henry A. Bennett

*Assistant Examiner*—John Sollecito

*Attorney, Agent, or Firm*—Dirk J. Veneman; Raymond W. Campbell; David J. Archer

[57] ABSTRACT

A vacuum roll transfer apparatus is disclosed for drying a web extending through a single tier dryer section of a paper machine. The apparatus includes a rotatable perforate shell having a first and a second end. A stationary duct is disposed within and along the length of the shell between the ends of the shell. The duct is connected to a source of partial vacuum and the shell defines a plurality of holes along the length thereof such that in use of the apparatus, when the duct is connected to the source of partial vacuum, a partial vacuum is generated within a chamber defined between the shell and the duct. A flow restricting arrangement is disposed within the duct for generating a greater vacuum level adjacent to at least one of the ends of the shell for facilitating threading of a tail of the web.

1 Claim, 2 Drawing Sheets

VACUUM ROLL TRANSFER APPARATUS

This is a divisional of copending application(s) Ser. No. 07/243,742 filed on Sept. 9, 1988 now U.S. Pat. No. 4,980,979. which is a continuation-in-part of Ser. No. 07/014,569 filed on Feb. 13, 1987 now U.S. Pat. No. 4,934,067.

BACKGROUND OF THE INVENTION

1. FIELD OF THE INVENTION

This invention relates to a vacuum roll transfer apparatus for drying a web extending through a single tier dryer section of a papermachine. More specifically, this invention relates to a vacuum transfer roll for a Total BelRun dryer section. Total BelRun is a Registered Trademark of Beloit Corporation.

2. INFORMATION DISCLOSURE STATEMENT

In co-pending U.S. Pat. application Ser. No. 014,569 filed Feb. 13, 1987 assigned to Beloit Corporation, a dryer section is disclosed which includes a plurality of single tier dryer sections, each dryer section including at least two dryers with a vacuum transfer roll interposed between adjacent dryers.

The aforementioned Total BelRun arrangement includes a dryer felt for each dryer section with the felt extending contiguously with the web alternately around each dryer and transfer roll. The partial vacuum applied to the vacuum roll provides a positive restraint to the web as the web and felt extend around the transfer roll with the felt being disposed between the web and the transfer roll.

As disclosed in U.S. Ser. No. 014,569, the vacuum roll includes a perforate shell and an internal duct arrangement with a seal or gasket disposed between the duct and the rotatable shell so that the vacuum can be concentrated in the vicinity of the wrapped portion of the transfer roll for urging the web into close conformity with the dryer felt. The aforementioned restraint helps to minimize cross-directional shrinkage and to improve the sheet quality and uniformity. The level of sheet restraint, and hence sheet quality can be increased by increasing the vacuum that is applied to the sheet as it wraps around the vacuum roll.

The problem with increasing the vacuum is that the volume of air which is drawn into the roll and which must thereafter be exhausted from the roll is proportionately increased. Such increased flow rate coupled with increased vacuum level causes an undesirable increase in the exhaust fan power requirements and additionally increases the amount of makeup air which must be supplied to the dryer hood.

The present invention overcomes the aforementioned problem by providing at least two internal flow restrictions. Such restrictions are located inside the roll near the outer edges thereof to allow the vacuum to be maintained at a high level adjacent to the edges or ends of the shell where the increased vacuum is most needed. Additionally, the arrangement of the present invention further allows the vacuum to be maintained at a lower level in between the edge or end portions of the roll shell where the increased vacuum is not required. Such an arrangement greatly reduces the volume of air which must be exhausted from the roll and thereby minimizes the exhaust fan horsepower.

Therefore, it is a primary object of the present invention to provide a vacuum roll transfer apparatus that overcomes the aforementioned problems associated with the dryer section arrangement disclosed in U.S. Ser. No. 014,569 and which makes a considerable contribution to the paper drying art.

Other objects and advantages of the present invention will be apparent to those skilled in the art by a consideration of the detailed description of a preferred embodiment of the present invention as described hereinafter taken in conjunction with the annexed drawings and as defined in the appended claims.

SUMMARY OF THE INVENTION

The present invention relates to a vacuum roll transfer apparatus for drying a web extending through a single-tier dryer section of a papermachine, the apparatus includes a rotatable perforate shell having a first and a second end. A stationary duct is disposed within and along the length of the shell between the ends of the shell. The duct is connected to a source of partial vacuum and the duct defines a plurality of holes along the length thereof such that in use of the apparatus, when the duct is connected to the source of partial vacuum, a partial vacuum is generated within a chamber defined between the shell and the duct. A flow restricting means generates a greater vacuum level adjacent to at least one end of the shell for facilitating threading of a tail of the web.

In a more specific embodiment of the present invention, the stationary duct is coaxial relative to the perforate shell.

In some of the embodiments, the duct is connected to the source of partial vacuum adjacent to the first and second ends of the shell.

In another embodiment of the present invention, the duct is connected to the source of partial vacuum adjacent to the first end of the perforate shell.

More particularly, in one embodiment of the present invention, the flow restricting means includes a first and a second damper which are disposed within the duct and adjacent to the first and the second ends of the shell respectively. The dampers are controllable for restricting the flow of air through the duct. Seal means extends circumferentially around the duct and extend from the duct to the perforate shell for dividing the chamber into a first cavity which is disposed adjacent to the first end of the shell, a second cavity which is disposed adjacent to the second end of the shell and an intermediate cavity which is disposed between the first and second cavities. The plurality of holes connect the respective cavities to the source of partial vacuum. A control valve controls the flow of air between the second damper and the source of partial vacuum such that when the control valve is closed and the first damper is closed, a high vacuum level is generated within the first cavity for facilitating threading of the tail of the web. When the control valve is open and the first and second dampers are closed, an intermediate vacuum level is generated within the first and the second cavities for inhibiting fluttering of the lateral edges of the web during transit of the web around the perforate shell. When the control valve is open and the first and second dampers are partially open, a low vacuum level is generated within the intermediate cavity.

In another embodiment of the present invention, the flow restricting means includes a first flow restrictor plate which is disposed within the duct adjacent to the first end of the perforate shell. A second restrictor plate is disposed within the duct adjacent to the second end of the shell. The first and the second plates are spaced axially relative to each other for dividing the duct into a first enclosure which is disposed adjacent to the first end of the shell, a second enclosure which is disposed adjacent to the second end of the shell and an intermediate enclosure which is disposed between the first and the second enclosures. Sealing means extend circumferentially around the duct and extend from the duct to the perforate shell for dividing the chamber into a first cavity which is disposed adjacent to the first end of the shell, a second cavity which is disposed adjacent to the second end of the shell and an intermediate cavity which is disposed between the first and second cavities. The plurality of holes connect the various cavities to the source of partial vacuum. Control valve means are disposed between the second plate and the source of partial vacuum such that when the control valve is closed, a high vacuum level is generated within the first enclosure and the first cavity for assisting threading of a tail of the web. When the control valve is open, an intermediate vacuum level is generated within the first and the second enclosures and the first and second cavities for inhibiting fluttering of the lateral edges of the web relative to the shell.

In a further embodiment of the present invention, the flow restricting means also includes a plurality of restriction elements which are spaced axially relative to each other and disposed within the duct between the first and the second dampers such that when the control valve is open and the dampers are partially open, an equal vacuum level is generated within the first and second cavities and a low vacuum level is generated within the intermediate cavity which is progressively greater towards the dampers due to the provision of the restriction elements.

In another embodiment of the present invention, the duct is connected to the source of partial vacuum adjacent to the first end of the perforate shell. The duct defines a first and a second pocket with the first pocket being disposed adjacent to the first end of the shell. The second pocket is disposed adjacent to the second end of the shell. The duct also defines a conduit which extends from the first to the second pocket. Sealing means extend circumferentially around the duct and extend from the duct to the perforate shell for dividing the chamber into a first cavity which is disposed adjacent to the first end of the shell, a second cavity which is disposed adjacent to the second end of the shell and an intermediate cavity which is disposed between the first and the second cavities. The plurality of holes connect the various cavities to the source of partial vacuum. The flow restricting means include a controllable damper which is disposed within the conduit such that when the damper is closed, a high vacuum level is generated within the first pocket and the first cavity for facilitating threading of the tail of the web. When the damper is open, an equal vacuum level is generated within the first and second pockets and the first and the second cavities for inhibiting fluttering of the lateral edges of the web during transit of the web around the shell.

The present invention also includes a method for transferring a web extending through a single-tier dryer section of a papermachine. The method includes the steps of guiding the web around a rotatable perforate shell of a vacuum roll transfer apparatus, the shell having a first and a second end, connecting a stationary duct disposed within and along the length of the shell to a source of partial vacuum, the duct defining a plurality of holes along the length thereof; and restricting the flow of air through the duct for generating a greater vacuum level adjacent to at least one end of the shell for facilitating threading of a tail of the web.

Many modifications and variations of the present invention may be carried out by those skilled in the art. However, such variations and modifications fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
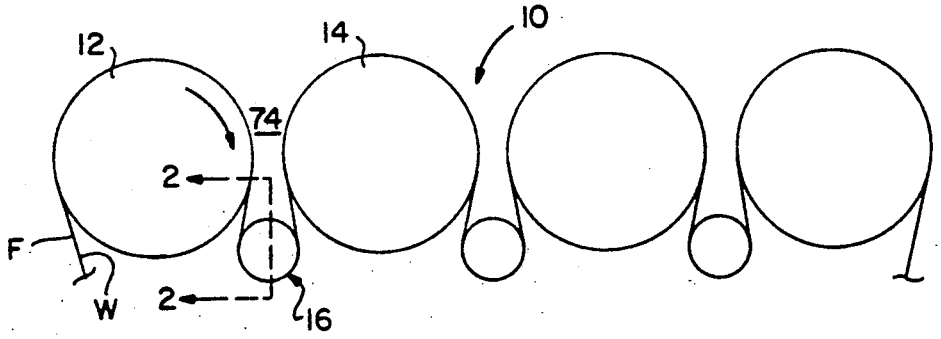
FIG. 1 is a side-elevational view of a single-tier, single felt dryer section according to the present invention.

FIG. 1 is a side-elevational view of a single-tier, single felt dryer section generally designated 10. The dryer section 10 includes a first and a second dryer 12 and 14 respectively and a vacuum roll transfer apparatus generally designated 16 according to the present invention disposed therebetween. A felt F and a web W extend contiguously around the dryer 12, the vacuum roll 16 and the dryer 14 such that the felt is disposed between the web W and the vacuum roll transfer apparatus 16 as the web and felt extend around the vacuum roll 16. By this means as disclosed in co-pending patent application Ser. No. 014,569, a positive restraint is applied to the web W by the vacuum roll 16 during transit of the web around the vacuum roll 16.

Figure 2:
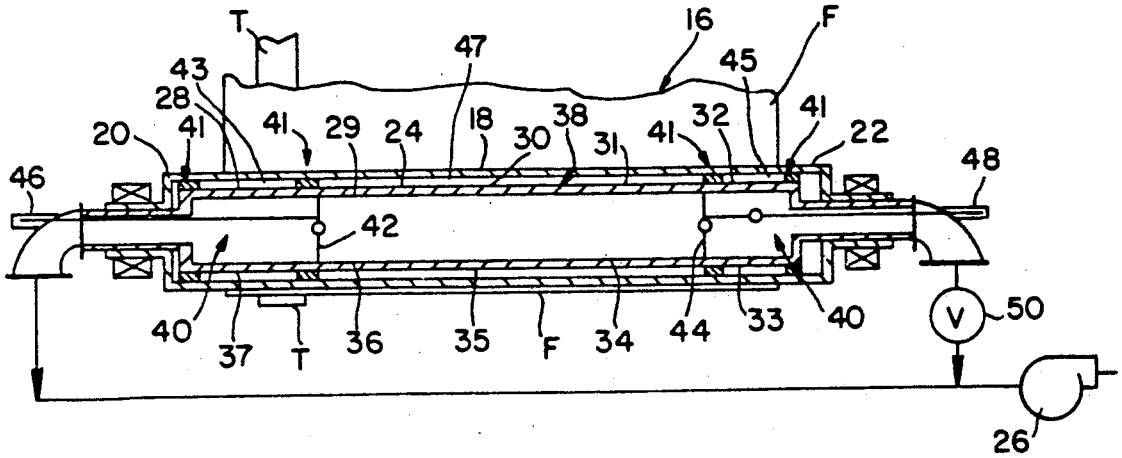
FIG. 2 is an enlarged sectional view taken on the line 2—2 of FIG. 1 showing the preferred embodiment of the present invention.

The vacuum roll transfer apparatus 16 is shown in more detail in FIG. 2 which is an enlarged sectional view taken on the line 2—2 of FIG. 1. The vacuum roll transfer apparatus 16 for drying the web W extending through the single-tier dryer section 10 of a papermachine includes a rotatable perforate shell 18 having a first and a second end 20 and 22 respectively.

A stationary duct 24 is disposed within and along the length of the shell 18 between the ends 20 and 22 of the shell 18. The duct 24 is connected to a source of partial vacuum 26 such as a fan and the duct 24 defines a plurality of holes 28, 29, 30, 31, 32, 33, 34, 35, 36 and 37 along the length thereof such that in use of the apparatus 10, when the duct 24 is connected to the source of partial vacuum 26, a partial vacuum is generated within a chamber 38 defined between the shell 18 and the duct 24.

Flow restricting means generally designated 40 are associated with the duct 24 for generating a greater vacuum level adjacent to at least one of the ends 20, 22 of the shell 18 for facilitating threading of a tail T of the web W.

More specifically, the duct 24 shown in FIG. 2 is coaxial with the shell 18 and the source of partial vacuum 26 is an exhaust fan connected to the duct 24 adjacent to the first and second ends 20 and 22 respectively of the shell 18.

The flow restricting means 40 includes a first and second controllable damper 42 and 44 respectively which may be butterfly valves connected by suitable means to actuating mechanisms 46 and 48 respectively.

The flow restricting means 40 further includes seal means generally designated 41 which extend circumferentially around the duct 24 and extend from the duct 24 to the perforate shell 18 for dividing the chamber 38 into a first cavity 43 which is disposed adjacent to the first end of the shell 18. The seal means 41 also divided the chamber 38 into a second cavity 45 which is disposed adjacent to the second end 22 of the shell 18. Furthermore, an intermediate cavity 47 is disposed between the first and the second cavities 43 and 45 respectively. The plurality of holes 28 to 37 connect the cavities 43, 45 and 47 to the source of partial vacuum 26.

The flow restricting means 40 also includes a control valve 50 which is disposed between the second damper 44 and the exhaust fan 26.

The arrangement is such that in use of the apparatus 10, when the control valve 50 is closed and the first damper 42 is closed, a greater vacuum level is generated within the first cavity 43 for facilitating threading of the tail T of the web W.

When the control valve 50 is open and the dampers 42 and 44 are closed, an intermediate vacuum level is generated within the cavities 43 and 45 for inhibiting fluttering of the lateral edges of the web W during transit of the web W around the shell 18.

When the control valve 50 is open and the dampers 42 and 44 respectively are partially open, a low vacuum level is generated within the intermediate cavity 47 and a slightly higher vacuum level is generated within the cavities 43 and 45 respectively for inhibiting fluttering of the lateral edges of the web W during transit of the web W around the shell 18.

Figure 3:
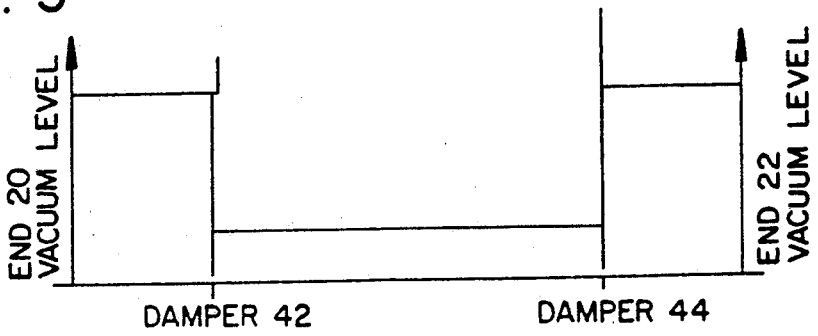
FIG. 3 is a graph showing the respective vacuum levels along the length of the transfer roll shown in FIG. 2 with the valve open and the dampers partially open.

FIG. 3 is a graph showing the intermediate vacuum level adjacent to the first and the second ends of the shell and the low vacuum level between the dampers when the control valve 50 is open and the dampers 42 and 44 are partially open.

Figure 4:
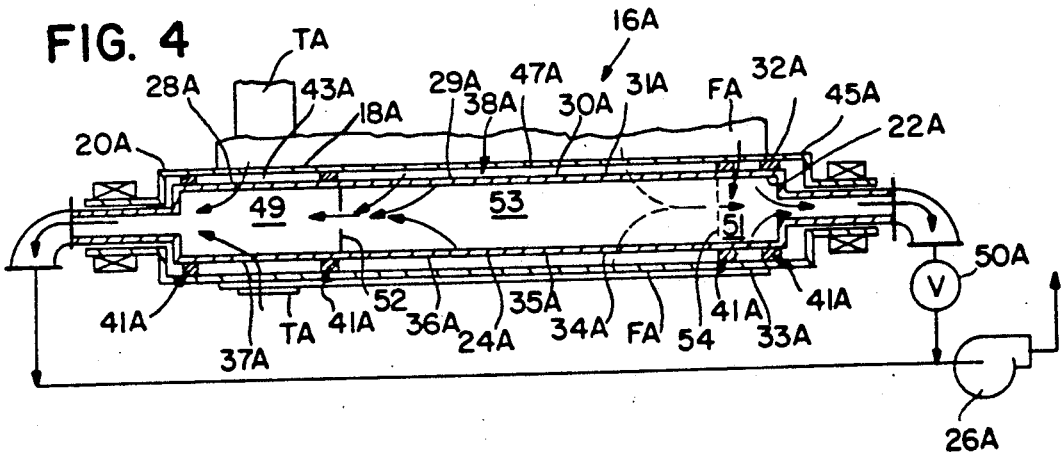
FIG. 4 is a sectional view similar to that shown in FIG. 2 but showing an alternative embodiment to the present invention.

FIG. 4 is a sectional view of an alternative embodiment of the present invention. It is similar to the view shown in FIG. 2 but instead of butterfly dampers the alternative embodiment includes an orifice plate or a drilled restrictor plate hereinafter referred to as a first flow restrictor plate 52 disposed adjacent to the first end 20A of the shell 18A. An orifice plate or a drilled restrictor plate hereinafter referred to as a second flow restrictor plate 54 is disposed adjacent to the second end 22A of the shell 18A. The plates 52 and 54 are spaced axially relative to each other for dividing the duct 24A into a first enclosure 49 which is disposed adjacent to the first end 20A of the shell 18A, a second enclosure 51 disposed adjacent to the second end 22A of the shell 18A and an intermediate enclosure 53 disposed between the first and the second enclosures 49 and 51 respectively. Seal means generally designated 41A extend circumferentially around the duct 24A and extend from the duct 24A to the perforate shell 18A for dividing the chamber 38A into a first cavity 43A disposed adjacent to the first end 20A of the shell 18A. The seal means 41A also divides the chamber 38A into a second cavity 45A which is disposed adjacent to the second end 22A of the shell 18A. Furthermore, an intermediate cavity 47A is disposed between the first and the second cavities 43A and 45A. The plurality of holes 28A, 29A, 30A, 31A, 32A, 33A, 34A, 35A, 36A and 37A connect the cavities 43A, 45A and 47A to the source of partial vacuum.

Control valve means generally designated 50A is disposed between the second plate 54 and the source of partial vacuum 26A such that when the control valve 50A is closed, a high vacuum level is generated within the first enclosure 49 and the first cavity 43A for assisting threading of a tail TA of the web. When the control valve 50A is open, an intermediate vacuum level is generated within the first and second enclosures 49 and 51 respectively and the first and second cavities 43A and 45A respectively for inhibiting fluttering of the lateral edges of the web relative to the shell 18A.

Figure 5:
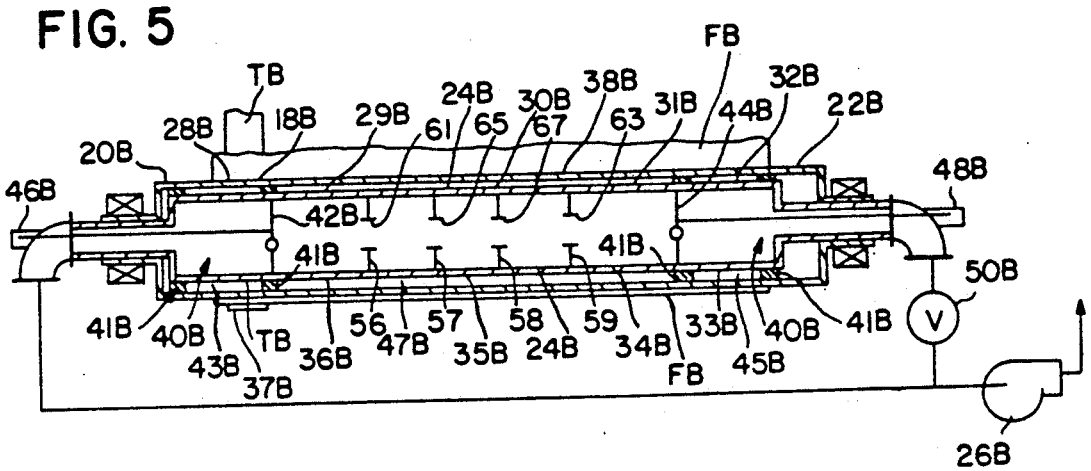
FIG. 5 is a sectional view similar to that shown in FIG. 2 but showing yet another embodiment to the present invention.

FIG. 5 shows another embodiment of the present invention which is similar to the embodiment shown in FIG. 2. However, the flow restricting means generally designated 40B further includes a plurality of restriction elements 56, 57, 58 and 59 which are spaced axially relative to each other and are disposed within the duct 24B between the first and second dampers 42B and 44B respectively such that when the control valve 50B is open and the dampers 42B and 44B are partially open, an equal vacuum level is generated within the first and second cavities 43B and 45B respectively and a low vacuum level is generated within the intermediate cavity 47B which is progressively greater towards the dampers 42B and 44B respectively due to the provision of the restriction elements 56 to 59.

As shown in FIG. 5, each of the restriction elements 56 to 59 defines an opening therein. However, the openings 61 and 63 defined by elements 56 and 59 respectively are larger than openings 65 and 67 defined by elements 57 and 58 respectively. By the provision of the openings 61, 63, 65 and 67 respectively, the low vacuum level generated within the intermediate cavity 47B becomes progressively greater towards the dampers 42B and 44B respectively.

Figure 6:
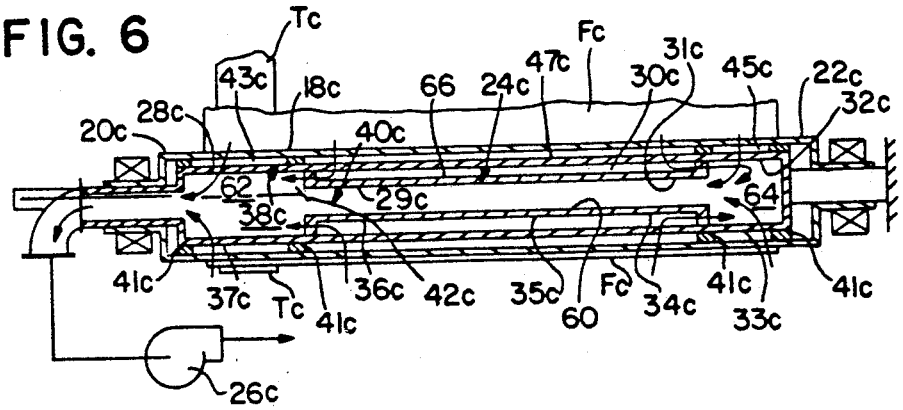
FIG. 6 is a sectional view similar to that shown in FIG. 2 but showing a further embodiment of the present invention in which the source of partial vacuum is connected to only one side of the duct.

FIG. 6 shows a further embodiment of the present invention in which the source of partial vacuum 26C is connected only to the duct 24C adjacent to the first end 20C of the shell 18C. The duct 24C defines a first and a second pocket 62 and 64 respectively. The first pocket 62 is disposed adjacent to the first end 20C of the shell 18C. The second pocket 64 is disposed adjacent to the second end 22C of the shell 18C. The duct 24C also defines a conduit 66 which extends from the first pocket 62 to the second pocket 64. Seal means generally designated 41C extend circumferentially around the duct 24C and extend from the duct 24C to the perforate shell 18C for dividing the chamber 38C into a first cavity 43C disposed adjacent to the first end 20C of the shell 18C, a second cavity 45C disposed adjacent to the second end 22C of the shell 18C and an intermediate cavity 47C disposed between the first and the second cavities 43C and 45C respectively. A plurality of holes 28C, 29C, 30C, 31C, 32C, 33C, 34C, 35C, 36C and 37C connect the cavities 43C, 45C and 47C respectively to the source of partial vacuum.

The flow restricting means generally designated 40C includes a controllable damper 42C disposed within the conduit 66 such that when the damper 42C is closed, a high vacuum level is generated within the first pocket 62 and the first cavity 43C for facilitating threading of a tail TC of the web. When the damper 42C is open, an equal vacuum level is generated within the first and second pockets 62 and 64 respectively and the first and second cavities 43C and 45C respectively for inhibiting fluttering of the lateral edges of the web during transit of the web around the shell.

In operation of the apparatus according to the present invention as shown in FIGS. 2 and 3, when the control valve is closed and the dampers are closed, the greater vacuum level is operative adjacent to the first end of the shell so that when a narrow tail of the web is guided towards the shell, the tail will be guided around the shell to facilitate threading of the tail through the dryer section.

When the tail has been widened to a full width web, the control valve is opened and the dampers 42 and 44 are shut so that the fan 26 generates an equal and intermediate vacuum level adjacent to the ends 20 and 22 of the shell. Such intermediate vacuum level inhibits the lateral edges of the full width web from fluttering relative to the supporting felt F during transit of the web around the shell 18 and provides restraint to the web to prevent shrinkage during the drying process.

When control valve 50 is open and the dampers 42 and 44 are partially open, a low vacuum level is attained between the dampers 42 and 44. The low vacuum level generates a low vacuum level within a pocket 74 defined by the first and the second dryers 12 and 14 and the felt F so that the web W is urged into close conformity with the felt during transit between the dryers 12 and 14 while a slightly higher vacuum level is generated adjacent to the respective ends of the shell for preventing fluttering of the edges of the web.

Operation of the apparatus as shown in FIG. 4 is similar to that of the embodiment of FIGS. 2 and 3 except in that the movable dampers are replaced by first and second flow restrictor plates 52 and 54. Such substitution simplifies construction of the transfer roll apparatus but results in a slightly lower vacuum level for facilitating threading of the tail because the plates are always open.

The embodiment shown in FIG. 5 operates similarly to the embodiment shown in FIG. 2 except in that when the control valve 50B is open and the dampers are open, the restriction elements 56 to 59 have openings 61, 63, 65 and 67 therein, resulting in a progressive increase in the vacuum level from the center of the duct between elements 57 and 58 towards the dampers 42B and 44B respectively.

In operation of the further embodiment shown in FIG. 6, only one movable damper is required and the arrangement permits connection to the fan with only the front end of the duct so that when the damper is closed, a greater vacuum level is generated within the first pocket 62 and the first cavity 43C. When the damper 42C is open, an intermediate vacuum level is generated within the first and second pockets 62 and 64 and the first and second cavities 43C and 45C for holding the lateral edges of the web against the dryer felt.

In view of the plurality of holes 29C to 36C, a low vacuum level is attained within the intermediate cavity 47C when the damper 42C is open and this vacuum level results in a low vacuum level within the pocket 74 for holding the web against the felt during transit of the web between the adjacent dryers.

The present invention provides a simple vacuum transfer roll apparatus for enabling threading of the tail of a web without the need of threading ropes and also provides means for preventing the lateral edges of the web from fluttering relative to the felt during transit around the shell and also restrains the web from shrinking by providing a large holding force for holding the edges.

The present invention also provides means for holding the web against the felt during movement of the web in the draws between the respective dryers and the shell.

What is claimed is:

1. A vacuum roll transfer apparatus for drying a web extending through a single tier dryer section of a paper machine, said apparatus comprising:

a rotatable perforate shell having a first and a second end;

a stationary duct disposed within and along the length of said shell between said ends of said shell, said duct being connected to a source of partial vacuum, said duct defining a plurality of holes along the length thereof such that in use of the apparatus, when said duct is connected to said source of partial vacuum, a partial vacuum is generated within a chamber defined between said shell and said duct;

flow restricting means for generating a greater vacuum level adjacent to at least one end of said shell for facilitating threading of a tail of the web;

said duct being connected to said source of partial vacuum adjacent to said first and second ends of said shell; and said flow restricting means including:

a first flow restrictor plate disposed within said duct adjacent to said first end of said perforate shell;

a second flow restrictor plate disposed within said duct adjacent to said second end of said shell;

said first and second plates being spaced axially relative to each other for dividing said duct into a first enclosure disposed adjacent to said first end of said shell, a second enclosure disposed adjacent to said second end of said shell and an intermediate enclosure disposed between said first and second enclosures;

seal means extending circumferentially around said duct and extending from said duct to said perforate shell for dividing said chamber into a first cavity disposed adjacent to said first end of said shell, a second cavity disposed adjacent to said second end of said shell and an intermediate cavity disposed between said first and second cavities, said plurality of holes connecting said cavities to said source of partial vacuum;

control valve means disposed between said second plate and said source of partial vacuum such that when said control valve is closed, a high vacuum level is generated within said first enclosure and said first cavity for assisting threading of the tail of the web, and when said control valve is open, an intermediate vacuum level is generated within said first and second enclosures and said first and second cavity for inhibiting fluttering of the lateral edges of the web relative to said shell.

* * * * *